US005985422A

United States Patent [19]

Krauter

[11] Patent Number: 5,985,422

[45] Date of Patent: Nov. 16, 1999

[54] THERMO-TRANSFER COLOR RIBBON FOR LUMINESCENT LETTERING

[75] Inventor: Heinrich Krauter, Hombrechtikon, Switzerland

[73] Assignee: Pelikan Produktions AG, Switzerland

[21] Appl. No.: 08/906,631

[22] Filed: Aug. 7, 1997

[30] Foreign Application Priority Data

Aug. 8, 1996 [DE] Germany ..... 196 32 111

[51] Int. Cl.[6] ..... B41M 5/40

[52] U.S. Cl. ..... 428/212; 428/195; 428/484; 428/488.1; 428/522; 428/690; 428/913; 428/914

[58] Field of Search ..... 428/195, 212, 428/484, 488.1, 488.4, 913, 914, 690, 522

[56] References Cited

FOREIGN PATENT DOCUMENTS

| | | | |
|---|---|---|---|
| 12 22 725 | of 0000 | Germany | 428/212 |
| 30 42 526 | of 0000 | Germany | 428/212 |
| 2270392 | 8/1993 | United Kingdom | 428/212 |

OTHER PUBLICATIONS

Patent Abstract of Japan, Application No. 6212064 dated May 18, 1987 for Thermal Transfer Recording Medium.

Patent Abstract of Japan, Application No. 62118641 dated May 14, 1987 for Thermal Transfer Recording Medium.

*Primary Examiner*—Bruce H. Hess

*Attorney, Agent, or Firm*—Fay, Sharpe, Beall Fagan, Minnich & McKee, LLP

[57] ABSTRACT

Description of a thermo-transfer color ribbon with (a) a carrier, (b) a layer of a first thermo-transfer color formed on one side of the carrier, containing a luminescent pigment and (c) a layer of a second thermo-transfer color formed on the first thermo-transfer color layer containing a non-luminescent pigment, whereby, where needed, additional layers may be located between the carrier and the layer of the first thermo-transfer color and/or the layer of the first and the second thermo-transfer color. Said thermo-transfer ribbon is characterized in that in the remission spectrum of the non-luminescent pigment, in the wave length range of the light emitted by the luminescent pigment there is a remission maximum or an ascending flank of remission. The thermo-ransfer ribbon furnishes print-outs of high optical density without affecting the luminesce output of the luminescent pigment.

7 Claims, 1 Drawing Sheet

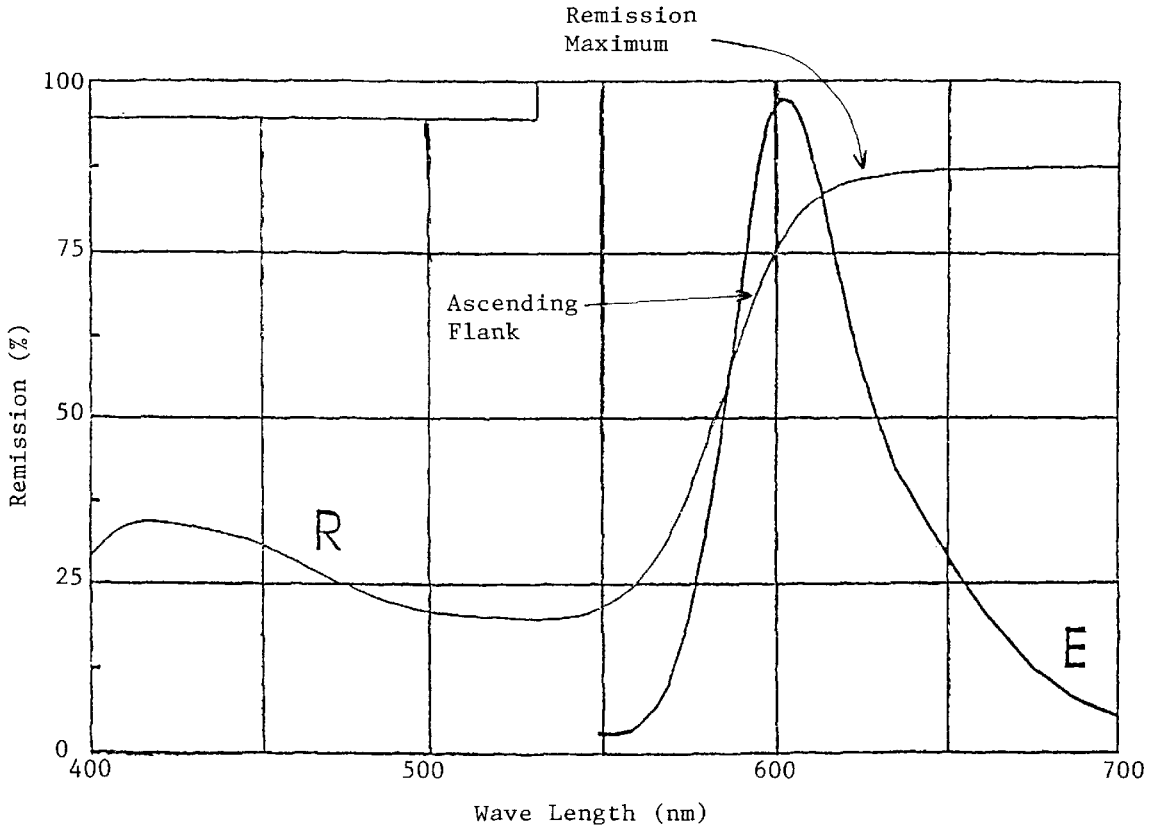
Remission
Maximum
Ascending
Flank
R
E
100
75
50
25
0
Remission (%)
400
500
600
700
Wave Length (nm)

THERMO-TRANSFER COLOR RIBBON FOR LUMINESCENT LETTERING

BACKGROUND OF THE INVENTION

The invention concerns a thermo-transfer color ribbon for luminescent lettering or coding.

Modem sorting machines, as they are being employed for a multitude of objects, such as for instance, letters, respond to luminescent coding, which is not necessarily visible to the human eye. For that purpose, the to be sorted pieces are provided prior to the sorting process with symbols which contain luminescent material. Thermo-transfer color ribbons are increasingly being used for this purpose, which have a layer of thermo-transfer dye with luminescent pigment contained therein. The luminescent transfer dye, which is transferred to the substrate surface, is very thin and transparent for visual inspection.

Luminescent dyes have the property of absorbing ultraviolet light and visible light in the blue part of the spectrum and radiate the absorbed part at the lower end of the spectrum. From among the great number of organic compounds which radiate visible light under the effect of short-wave rays, only such substrates are suitable as luminescent dyes or lumogens which distinguish themselves in solid, non-dissolved state through intensive fluorescence. Of greatest technical interest are those luminescent dyes, which fluoresce colored in daylight and which are utilized as day-glow fluorescent pigments. Soluble dyes of this type are for example, Rhodamin, Eosin, brilliant sulfoflaven FF as well as the intensively yellow-green fluorescing pyranin, also color pigments, for example 2.2-dihydroxy-alpha-napthaldiazine and anthrapyrimidine. Since the dyes are organic in nature, it is necessary to dissolve them with an organic medium or carrier. One uses predominantly tinted carrier materials, for example, pulverized polymerisates, which have been tinted with soluble dyes or finely dispersed pigments. The material types which correspond to the requirements as a carrier or a matrix for the dyes are transparent organic resins. By reacting acid polyester resins with alkaline dyes or by pulverizing solidified dye solutions one likewise obtains tinted carrier substances. Urea formaldehyde resins, acrylic resins and melamine resins are also used as carriers, on which the dyes are lacquered on, where necessary. Day-glow fluorescent pigments are organic synthetic material particles, which are tinted with fluorescent dyes. The physical structure of the pigment particles is primarily amorphous. The day-light fluorescent pigments are sold on the market under the names Lumogens (BASF), Day Glo® Colors, Goldfire Colors, Fluorzink or Brillink-Glow-Colors.

Thermo-transfer ribbons have been known for some time. They have foil-like carriers, for example made of paper, of a synthetic material or similar, a thermo-transfer color, specifically in form of a synthetic-and/or wax-bonded dye-or a carbon black layer. In thermo-print technology, the thermo-transfer color is softened by means of a thermal print head and transferred to a substrate. Thermal printers or thermal print heads, which are utilized for this purpose are known, for example, from DE-AS 20 62 495 and 24 06 613 and also from DE-OS 32 24 445. The various steps of the process are detailed as follows: A letter is formed on the thermal print head of the printer, which consists of heated dots and is to be printed onto a piece of paper. The thermal print head presses the thermo-transfer ribbon on the printing paper. The heated letter of the thermal print head, having a temperature of up to approximately 400° C., causes the thermo-transfer color to be softened at the heated spot and be transmitted on the piece of paper in contact with the same. The used portion of the thermo-transfer ribbon is then passed to a spool.

For printing, socalled serial printers or line printers can be used. The serial printers operate with a relatively small, movable print head of up to approximately 1 $cm^2$. On it are arranged, in vertical direction to the writing direction, 1 or 2 rows of dots (dot=selective approach heating point). The dot diameter ranges from approximately 0.05 to 0.25 mm. The number of dots per line is between 6 and 64, which corresponds to a resolution of 2 to 16 dots/mm. It is typical with respect to the serial thermo head, that it is moved during the printing process in horizontal direction vis-a-vis the transport direction of the paper. In contrast to the serial print head, with respect to a line print head we are dealing with a stationary head or strip. Inasmuch as the print strip is not mobile, it must span across the width of the substrate which is to be printed. Resolution and dot size correspond to those of serial heads. When luminescent material is deposited on white paper, the whiteness of the paper serves as light reflector. The largest portion of the incident light is reflected back by paper through the printed luminescent material. The reflected light noted by the observer contains both incident light and also luminescence light.

If the luminescent material is transferred to the surface of a darkly colored paper, then a portion of the incident light, which has passed through the luminescent light, is absorbed by the paper. The amount of available light due to re-reflection is decreased. In addition, that portion of light emitted by the luminescence layer is being absorbed, which is radiated in the direction of the paper surface.

In order to compensate for the luminescence intensity differences, which is based on the type of carrier, DE-OS 30 42 526 proposes a fluorescent print ribbon, which is characterized by addition of a blocking material to the fluorescence pigment material, in order to block absorption of incident light in the medium, onto which the pigment and the blocking coating is transferred during printing. The blocking material is preferably transferred as second layer over the pigment material layer. Both layers are transferred to the substrate in reverse order during the printing process. The blocking material contains reflecting metal particles or mother-of-pearl type pigments.

DE-AS 12 22 725 discloses a transfer material for luminescent lettering with a coating support of paper or foil and a luminescent color layer arranged thereon, whereby a pigmented cover layer is positioned over the luminescent, light radiation reflecting color layer which participates in the writing process. The cover layer preferably contains titanium white and/or aluminum print etching powder.

The known suggestions are aimed at preventing an absorption in the substrate of the incident light, which passes through the luminescence layer, so that this part is reflected and again passes through the luminescence color layer, in order to thus increase total excitation yield. The disadvantage hereby is that the luminescence light noted by the observer is always mixed with the reflected part of the incident light. The luminescent print outs therefore always appear pale, i.e., they have a low optical density.

If one attempts to increase the optical density of the print-outs by addition of a non-luminescent pigment to the layer of the luminescent pigment, one notes that with an addition of extraneous pigments of more than 1%, fluorescence quality will be significantly affected. With increased additional amounts, the brilliance of the fluorescence pigments, fluorescence intensity and purity of color will increasingly be affected because of the appearance of interferences. Still larger additional amounts lead to an almost complete extinction of the fluorescence. From a fluorescence yield aspect, an acceptable additional amount of 1% or below would only insignificantly increase the optical density.

SUMMARY OF THE INVENTION

The invention is therefore based on making available a thermo-transfer ribbon for luminescent encodings, with which print-outs of high optical density are attainable, without affecting the luminescence output of the luminescent pigment and independently from the to be imprinted substrate.

This object according to the invention, is solved by means of a thermo-transfer ribbon, which has (a) a carrier, (b) a first thermo-transfer color containing a luminescent pigment, formed on one side of the carrier, and (c) a second thermo-transfer color containing a non-luminescent pigment, formed on the layer of the first thermo-transfer color, whereby there is in the remission spectrum of the non-luminescent pigment, in the wave lengths of the light emitted by the luminescence pigment, a remission maximum or an ascending flank of remission. Additional layers may be located between the carrier and the layer of the first thermo-transfer color and/or the layer of the first and the second thermo-transfer color.

DESCRIPTION OF THE DRAWINGS

The figure is a graphical presentation of the fluorescence spectrum and remission spectrum of the present inventive color ribbon.

DETAILED DESCRIPTION

The non-luminescent pigment to be employed in accordance with the invention thus only reflects the light emitted by the luminescent pigment and the wave length portion of the non-absorbed incident light which lies next to or close to the (longest wave) emission bands of the luminescent pigment. The obtained print-outs thus give the effect of substantially greater contrast and show improved optical density. Selection of the non-luminescent pigment, permits, within certain limitations, variation of the shade of the print-out, without loss of brilliancy, in that the emitted light and the light remitted by the non-luminescent pigment intersect.

The non-luminescent pigment is a pigment, remission of which greatly depends upon wave lengths. The color impression of a non-luminescent pigment is created as a result of selective reflection of some segments of the visible white light spectrum.

The non-reflecting portion is absorbed and transformed into heat. An orange-red color, for example, reflects the orange-red portion of light and absorbs all other colors of the spectrum. Effective non-luminescent pigments are capable of reflecting approximately 90% of the corresponding portion of the spectrum. White pigments, however, show a non-selective high reflection across the entire visible spectrum.

It is preferred, for purposes of the invention, that the luminescent pigment is a day-light fluorescence pigment and the non-luminescent pigment is a color pigment. In view of the intended application in postage cancellation printers, the day-light fluorescence pigment preferably emits in the wave length range of orange to red, i.e. at approximately 580 to 620 nm (with an excitation energy of 254 nm). The preferred color pigment hereby is a red pigment, whereby this term should be understood to mean it's most comprehensive sense possible.

Although the type of binding agent for the first thermo-transfer color is not critical for the invention, it is preferred that the binding agent of the first thermo-transfer color consists of a mixture of a hydrocarbon paraffin and/or ester paraffin with an ethylene/vinyl-acetate-copolymerisate and/or hydrocarbon resin. It is likewise preferred that the binding agent of the second thermo-transfer color consists of a mixture of a hydrocarbon paraffin and/or ester paraffin with an ethylene vinyl-acetate copolymerisate and/or hydrocarbon resin.

Preferably employed hydrocarbon paraffins and/or ester paraffins have a melting point of approximately 70 to 110° C., specifically of approximately 75 to 90° C. Paraffins of this type come under the classification of natural waxes, chemically modified waxes and synthetic waxes. Specifically preferred among the natural waxes are vegetable waxes in the form of camauba wax, candelilla wax, mineral waxes in the form of higher melting ceresin and higher melting ozokerite, petrochemical waxes such as for example petrolatum, paraffin waxes and micro-waxes. Preferred among the chemically modified waxes are montan ester wax, hydrated castor oil and hydrated jojoba oil. Preferred among the synthetic waxes are polyalkylene waxes and polyethylene-glycol waxes, and also products produced from these by means of oxidation and/or esterification. Modified micro-crystalline waxes are specifically preferred. If a melting point of 70° C. is not attained, it means that the mechanical anchoring is insufficient. Higher than 110° C. detrimentally results in increased energy expenditure during the printing process.

Among the waxes employed according to the invention, "narrowly cut" waxes are preferably utilized, whose melting and solidification points lie close to each other. The temperature difference between melting and solidification point is preferably less than about 10° C., specifically less than approximately 7° C. and more specifically less than approximately 5° C. A good example is carnauba wax, with a melting point of approximately 85° C. and a solidification point of approximately 78° C. The mentioned waxes result during the printing process in a desirably low cohesion of the thermo-transfer color.

Incorporated into the wax materials of the wax-bonded thermo-transfer color(s) in the preferred specific embodiment is an ethylene/vinyl copoymerisate and/or hydrocarbon resin. These additions regulate the stickiness of the preferably employed hard waxes and effect their plastification, in other words, they eliminate the brittleness or "splintering property" from the thermo-transfer color.

The thermo-transfer color(s) of the thermo-transfer ribbon according to the invention preferably has (have) a viscosity of approximately 50 to 200 mPa.s., specifically of approximately 70 to 120 mPa.s., at a temperature of 100° C., determined by rotation viscometer Rheomat 30 with rheograph (see Bulletin T 304d-7605 by Messrs. Contraves AG, Zurich/Switzerland).

The layer of the first thermo-transfer color containing the luminescent pigment has preferably a thickness of approximately 2 to 5 $\mu$m, specifically approximately 3 to 3.5 $\mu$m. The layer of the second thermo-ransfer color containing the non-luminescent layer is preferably about 1 to 3.5 $\mu$m thick, specifically about 2 to 2.5 $\mu$m.

The carrier of the color ribbon according to the invention is not critical. Preferably polyethylene therephthalate foils (PETP) or capacitor tissue is used as basic foil for the thermo-transfer ribbons. Selection parameters are stress-strain values as high as possible and thermal stability combined with thin foil thicknesses. The PETP foils are available as thin as approximately 2.5 $\mu$m and the capacitor tissue as thin as approximately 6 $\mu$m. A preferred foil thickness is approximately 3.5 to 5 $\mu$m, specifically approximately 4.5 $\mu$m.

Additional layers, such as for example separation layers or release layer or adhesive layers can be arranged between the carrier and the layer of the first thermo-transfer color and/or layer of the first and the second thermo-transfer color.

During the printing process, the thermo print head reaches temperatures of up to 400° C., i.e. temperatures which are above the softening point of PETP. With use of PETP foils it is recommended to provide, on the reverse side of the foil which comes into contact with the thermo head, a layer which is particularly heat resistant.

In a preferred embodiment, a layer of wax or wax-like material is formed on the reverse side of the carrier, specifically having a thickness of no more than approximately 1 μm and particularly preferred in the form of the molecularly formed layer of approximately 0.01 to 0.1 μm. The coating material consists in this case preferably of silicone, natural waxes, specifically camauba wax, bees wax, ozokerite and paraffin wax, synthetic waxes and polyethylene waxes, glycols or poly-glycols, antistatic materials and/or tensides. If such reverse side coating is provided, heat transfer without interference from the thermo print head to the thermo-transfer ribbon takes place resulting in the attainment of particularly sharp prints.

The thermo-transfer ribbon according to the invention is beneficially used in a "near-edge" type printer, specifically in postage cancellation machines. Quite unexpected, any type of paper can be used with excellent print quality, i.e. smooth as well as rough papers. The layer of the second thermo-transfer color seems to act as "top coat", which equalizes the surface unevenness of the paper.

The invention is now explained in more detail on the basis of the following example.

EXAMPLE

On a customary carrier made of a polyester, having a layer thickness of 4.5 μm, a thermo-transfer color is applied in form of melting material according to the following recipe:

| | |
|---|---|
| Paraffin wax | 42 parts by weight |
| EVA 28/800 (Ethylene-Vinylacetate-Copolymer; vinylacetate content 28%, melting index 800 g/10 min) | 8 parts by weight |
| EVA 1-Wax (Polyethylene wax on basis of an ethylene-vinylacetate-copolymer) | 8 parts by weight |
| carnauba wax | 15 parts by weight |
| Petrolite WB 17 (microcrystalline wax) | 2 parts by weight |
| Dayglo Rocket Red (luminescence pigment) | 25 parts by weight |
| | 100 parts by weight |

Following solidification, a thermo-transfer color is applied in the form of melted material in a second step, based on the following recipe:

| | |
|---|---|
| Paraffin wax | 41 parts by weight |
| EVA 28/800 (Ethylene-vinylacetate-copolymer, vinylacetate content 28%, melting index 800 g/10 min) | 10 parts by weight |
| S-wax | 35 parts by weight |
| permanent lacquer red (pigment) | 14 parts by weight |
| | 100 parts by weight |

The obtained color ribbon, compared with a color ribbon which had only the layer of the luminescent transfer color, prints with clearly increased optical density without loss of luminesce output.

For purposes of clarification, the attached Figure depicts the fluorescence spectrum (E) of the employed luminescent pigment as well as the remission spectrum (R) of the employed non-luminescent pigment. Permanent lacquer red has its absorption maximum in the range of approximately 550 nm. At 580 nm, only about 50% of the light is absorbed. With higher wave lengths up to 700 nm, remission reaches 90%. Dayglo Rocket Red has an emission maximum at 600 nm.

During the manufacture of the color ribbon according to the invention, the layers of the thermo-transfer colors are successively applied onto the carrier or the solidified layer of the first thermo-transfer color, in form of melted material, according to customary application technologies, such as for example with a squeegee. Temperature of the respective melted material should, as a rule, be approximately 100 to 130° C. The luminescent pigment must be compatible with a hot wax/EVA mixture of up to at least 120° C. A luminescent pigment with high-heat resistant Duroplast matrix is used, with the latter not being subject, under these conditions, to melting or agglutination. After application, the applied materials are permitted to cool down.

I claim:

1. A thermo-transfer ribbon comprising (a) a carrier, (b) a layer formed on one side of the carrier of a first thermo-transfer color containing a luminescent pigment, and (c) a layer formed on the first thermo-transfer color of a second thermo-transfer color containing a non-luminescent pigment, wherein the remission spectrum of the non-luminescent pigment, in the wave length range of the light emitted by the luminescent pigment, includes a remission maximum or an ascending flank of the remission, wherein additional layers may be located between the carrier and the layer of the first thermo-transfer color and/or the layer of the first and second thermo-transfer color.

2. The thermo-transfer color ribbon according to claim 1, wherein the luminescence pigment is a day-light fluorescence pigment and the non-luminescent pigment is a color pigment.

3. The thermo-transfer color ribbon according to claim 2, wherein the day-light fluorescence pigment emits in the wave length range from orange to red, and the color pigment is a red pigment.

4. The thermo-transfer color ribbon according to claim 1, wherein the binding agent of the second thermo-transfer color consists of a mixture of hydrocarbon paraffin and/or ester wax with an ethylene/vinyl-acetate co-polymerisate and/or hydrocarbon resin.

5. The thermo-ransfer color ribbon according to claim 1, wherein the binding agent of the second thermo-transfer color consists of a mixture of a hydrocarbon paraffin and/or ester wax with an ethylene/vinylacetate-copolymerisate and/or hydrocarbon resin.

6. The thermo-transfer color ribbon according to claim 1, wherein the layer of the first thermo-transfer color has a thickness of approximately up to 5 μm.

7. The thermo-transfer color ribbon according to claim 1, wherein the layer of the second thermo-transfer ribbon has a thickness of approximately up to 1 to 3.5 μm.

* * * * *